US007520783B2

(12) United States Patent
Chou et al.

(10) Patent No.: US 7,520,783 B2
(45) Date of Patent: Apr. 21, 2009

(54) ENERGY SAVING OUTLET HAVING A SENSOR AND METHOD OF USE THEREOF

(75) Inventors: Jonie Chou, Jhonghe (TW); Yu-Lung Lee, Jhonghe (TW)

(73) Assignee: Powertech Industrial Co., Ltd., Taipei County (TW)

( * ) Notice: Subject to any disclaimer, the term of this patent is extended or adjusted under 35 U.S.C. 154(b) by 678 days.

(21) Appl. No.: 11/201,173

(22) Filed: Aug. 11, 2005

(65) Prior Publication Data

US 2007/0038334 A1 Feb. 15, 2007

(51) Int. Cl.
*H01R 25/00* (2006.01)

(52) U.S. Cl. ..... 439/652

(58) Field of Classification Search ..... 439/501, 439/682, 502, 535, 650–655; 340/628–629; 361/115–116

See application file for complete search history.

(56) References Cited

U.S. PATENT DOCUMENTS 5,731,947 A * 3/1998 Hirose ..... 361/160
6,315,617 B1 * 11/2001 Al-Sabah ..... 439/652
7,043,543 B2 * 5/2006 Ewing et al. ..... 709/223
7,154,402 B2 * 12/2006 Dayoub ..... 340/628
2004/0142601 A1 * 7/2004 Luu ..... 439/652

* cited by examiner

*Primary Examiner*—Chandrika Prasad
(74) *Attorney, Agent, or Firm*—Guice Patents PLLC

(57) ABSTRACT

The present invention relates to an energy saving outlet, which comprises: a housing, having at least one first opening and a second opening thereon, for disposing the following elements at least one outlet, disposed in the housing and exposed the first opening, for providing an electrical equipment being plugged into; a sensor, disposed in the housing and exposed the second opening, for sensing a starting signal of the electrical equipment; a control unit, disposed in the housing and coupled to the sensor, for outputting a control signal when it receives the starting signal; a relay, one end being coupled to a power input terminal, and another end being coupled to the control unit, for being changed to an on or off state through the control signal; thereby the energy saving outlet can turn OFF its power when the electrical equipment has entered a stand-by state, so as to achieve the goal of energy saving. Furthermore, the present invention also provides an energy saving method by using an outlet.

16 Claims, 9 Drawing Sheets

ENERGY SAVING OUTLET HAVING A SENSOR AND METHOD OF USE THEREOF

REARGROUND OF THE INVENTION

1. Field of the Invention

The present invention relates to an energy saving outlet, more particularly, it relates to an energy saving outlet which can turn OFF its power when the electrical equipment is in a stand-by state, and to turn ON its power when it senses a starting signal of the electrical equipment so as to achieve the goal of energy saving.

2. Description of the Related Art

In general, the electrical equipment, such as television, DVD player or air conditioner, generally has a remote control function, so that the user can easily control the electrical equipment by using a remote controller. The remote controllable electrical equipment must be turned ON its power and entered a stand-by state so as to enable the electrical equipment to receive the control signal(s) from the remote controller, thus the electrical equipment will cause stand-by current and consume power. Although the stand-by current is not huge even minor, but the electrical equipment must be turned ON long-term, therefore, the accumulated power consumed is very significant. Furthermore, the electrical equipment is generally plugged into an outlet for getting the power supply, however, the outlet maybe has a surge absorbing or overload protecting function, but the prior art outlet does not have the energy saving function.

There is therefore a need for a new and improved strategy and technique of a structure of an electrical outlet for overcoming these deficiencies and the present invention overcomes these deficiencies in a new and novel fashion.

SUMMARY OF THE INVENTION

According to one aspect of the present invention, the present invention provides an energy saving outlet, which can turn OFF its power when the electrical equipment is in a stand-by state, and turn ON its power when it senses a starting signal of the electrical equipment so as to achieve the goal of energy saving.

According to another aspect of the present invention, the present invention provides an energy saving outlet, which can determine the current amount of the outlet higher than a predetermined value or not, so as to determine if the starting signal is an error signal or not.

According to another aspect of the present invention, the present invention also provides an energy saving method by using an outlet, which can eliminate the stand-by current and save the power consumed while the electrical equipment is during stand-by state.

For reaching the aforesaid object, wherein, the energy saving outlet, which mainly comprises: a housing, having at least one first opening and a second opening thereon, for disposing the following elements: at least one outlet, disposed in the housing and exposed the first opening, for providing an electrical equipment being plugged into; a sensor, disposed in the housing and exposed the second opening, for sensing a starting signal of the electrical equipment; a control unit, disposed in the housing and coupled to the sensor, for outputting a control signal when receives the starting signal; a relay, one end being coupled to a power input terminal, and another end being coupled to the control unit, for being changed to an on or off state through the control signal; thereby the energy saving outlet can turn OFF its power when the electrical equipment has been become a stand-by state, so as to achieve the goal of energy saving.

For reaching the aforesaid object, wherein, the energy saving method by using an outlet comprises the steps of: providing at least one outlet, which at least comprises a sensor, a control unit, a relay and a current sensor; plugging a plug of a remote controllable electrical equipment into the outlet; the control unit will record the current amount of the outlet after the sensor sensing a starting signal emitted form a remote controller of the electrical equipment; the control unit determining that the current amount is changed or not; the control unit will turn OFF the relay after a first certain time if the current amount remains unchanged, so as to turn OFF the power of the outlet; the control unit will record the current amount as a stand-by current reference value of all electrical equipments if the current amount is changed; and the control unit will turn OFF the relay if the current amount approaches the reference value and remains a second certain time so as to turn OFF the power to the outlet and save power during the stand-by state.

BRIEF DESCRIPTION OF THE DRAWING PORTIONS

DETAILED DESCRIPTION OF THE PREFERRED EMBODIMENT

Figure 1:
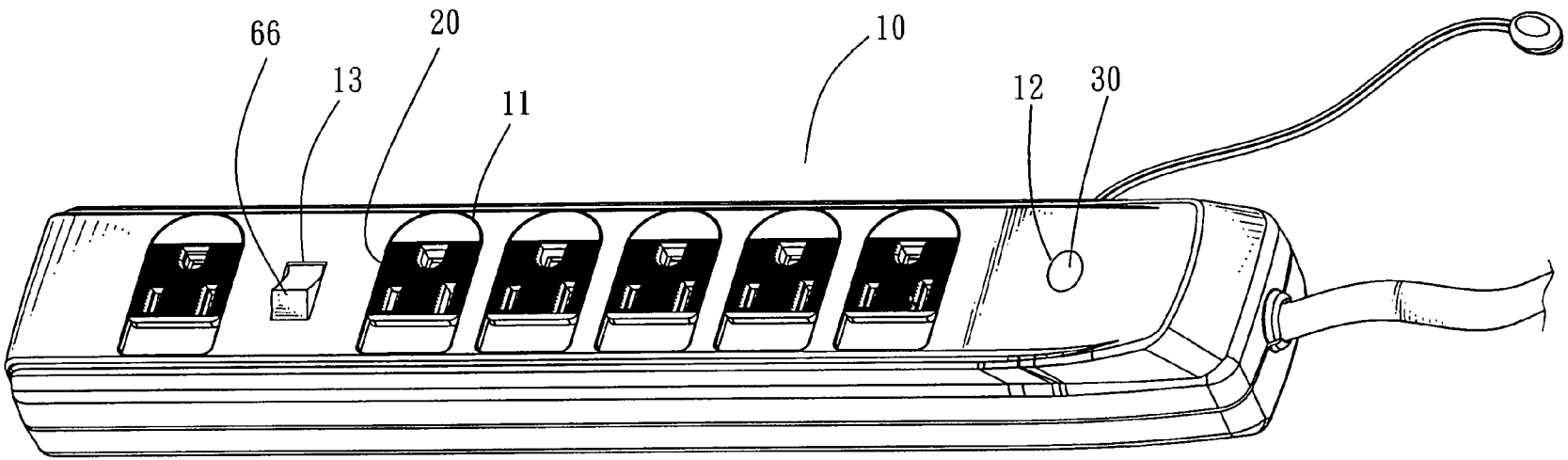
FIG. 1 shows an assembly view of an energy saving outlet according to one embodiment of the present invention.
Figure 2:
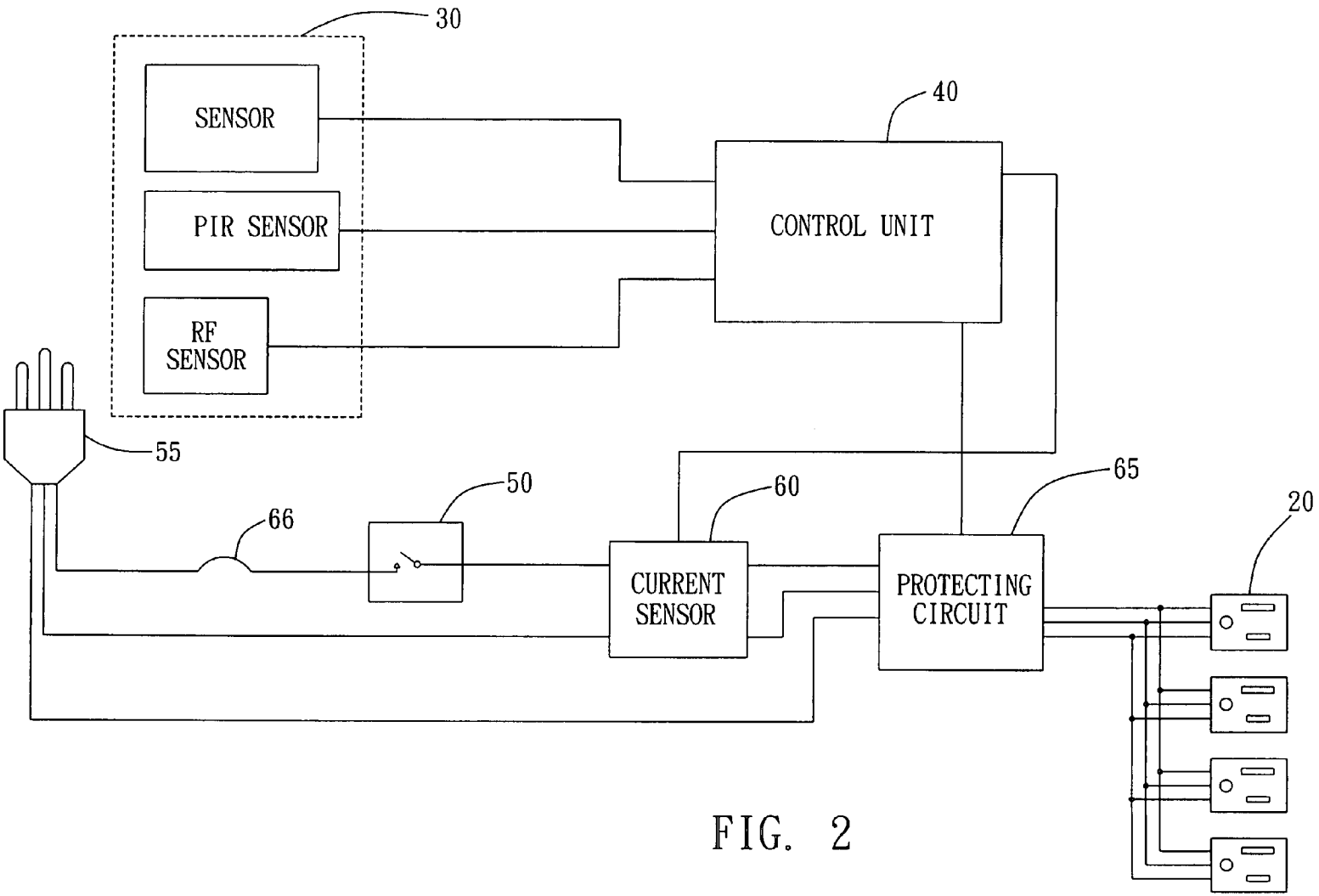
FIG. 2 shows a block diagram of the energy saving outlet according to one embodiment of the present invention.

Referring to FIGS. 1~2, wherein the FIG. 1 shows an assembly view of an energy saving outlet according to one embodiment of the present invention; while the FIG. 2 shows a block diagram of the energy saving outlet according to one embodiment of the present invention. As shown in the Figs. the energy saving outlet of the present invention mainly comprises: a housing 10; at least one outlet 20; a sensor 30; a control unit 40 and a relay 50.

Wherein, the housing 10 is made of the insulation material, for example but not limited to a plastic material and has at least one first opening 11 and a second opening 12 thereon, for disposing the outlet 20, sensor 30; control unit 40 and relay 50.

The outlet 20 is a general AC 110V or 220V 2 holes or 3 holes power outlet and disposed in the housing 10 as well as exposed the first opening 11 for providing a plug of an electrical equipment (not shown) being plugged into and get the required operating power. Wherein, the amount (i.e., the quantity) of the outlet 20 is equal to the amount (i.e., the quantity) of the first opening 11, in one preferred embodiment, the energy saving outlet of the present invention has a plurality of outlets 20 and first openings 11, such as 6 outlets 20 and 6 first openings 11, respectively.

The sensor 30 is disposed in the housing 10 and exposed the second opening 12 for sensing a starting signal of the electrical equipment, such as television, air conditioner or DVD player etc., wherein, the sensor 30 is for example but not limited to an Infrared (IR) sensor, a pyroelectric passive infrared (PIR) sensor, a radio frequency (RF) sensor or their combination; wherein, if the sensor 30 is an Infrared sensor 30, it can sense any Infrared signal emitted by a remote controller of the electrical equipment (not shown); if the sensor 30 is a pyroelectric passive infrared sensor, it can sense any movement of a human being; and if the sensor 30 is a radio frequency sensor, it can sense any specific radio frequency signals emitted by the remote controller of the electrical equipment. The sensor 30 of the present invention can be an Infrared (IR) sensor, a pyroelectric passive infrared (PIR) sensor, a radio frequency (RF) sensor or their combination; for example, the embodiment shown in FIG. 1, has an Infrared sensor 30; the embodiment shown in FIG. 3, has a pyroelectric passive infrared (PIR) sensor 30; and the embodiment shown in FIG. 4, has a radio frequency (RF) sensor 30. Furthermore, the amount and type of the sensor 30 can be decided according to the requirement, that is, the energy saving outlet of the present invention can exist more than one Infrared (IR) sensor, pyroelectric passive infrared (PIR) sensor, radio frequency (RF) sensor or their combination.

The control unit 40 is disposed in the housing 10 and coupled to the sensor 30. It can be a microcontroller and further comprises a memory and an analog to digital conversion port (not shown), wherein, the control unit 40 can output a control signal to open the power of the outlet 20 when it receives the starting signal from the remote controller.

The relay 50, one end is coupled to a power input terminal 55, and another end is coupled to the control unit 40, for being changed to an ON or OFF state through the control signal transmitted by the control unit 40.

When the energy saving outlet of the present invention is assembled completely, the relay 50 remains at the OFF state and no power is supplied to the outlets 20 due to the sensor 30 has not received the starting signal emitted from the remote controller, therefore, the electrical equipment, such as television, will not generate the stand-by current and consume power; when the sensor 30 has received the starting signal emitted from the remote controller, the control unit 40 will emit a control signal to the relay 50 and make the relay 50 to be changed to the ON state, therefore, the power will supply to the outlets 20, so that the electrical equipment can be normally operated. Therefore, the energy saving outlet of the present invention will not generate the stand-by current and consume power, so as to achieve the goal of energy saving and overcome the aforesaid drawbacks of the prior art outlet.

Furthermore, the energy saving outlet of the present invention further comprises a current sensor 60 coupled between the relay 50 and the controller unit 40, which can sense the current amount (i.e., the electrical current flow or "current") of the outlet 20 and feed it back to the analog to digital conversion port and transmit it to the control unit 40 after being converted into a digital signal.

Figure 8:
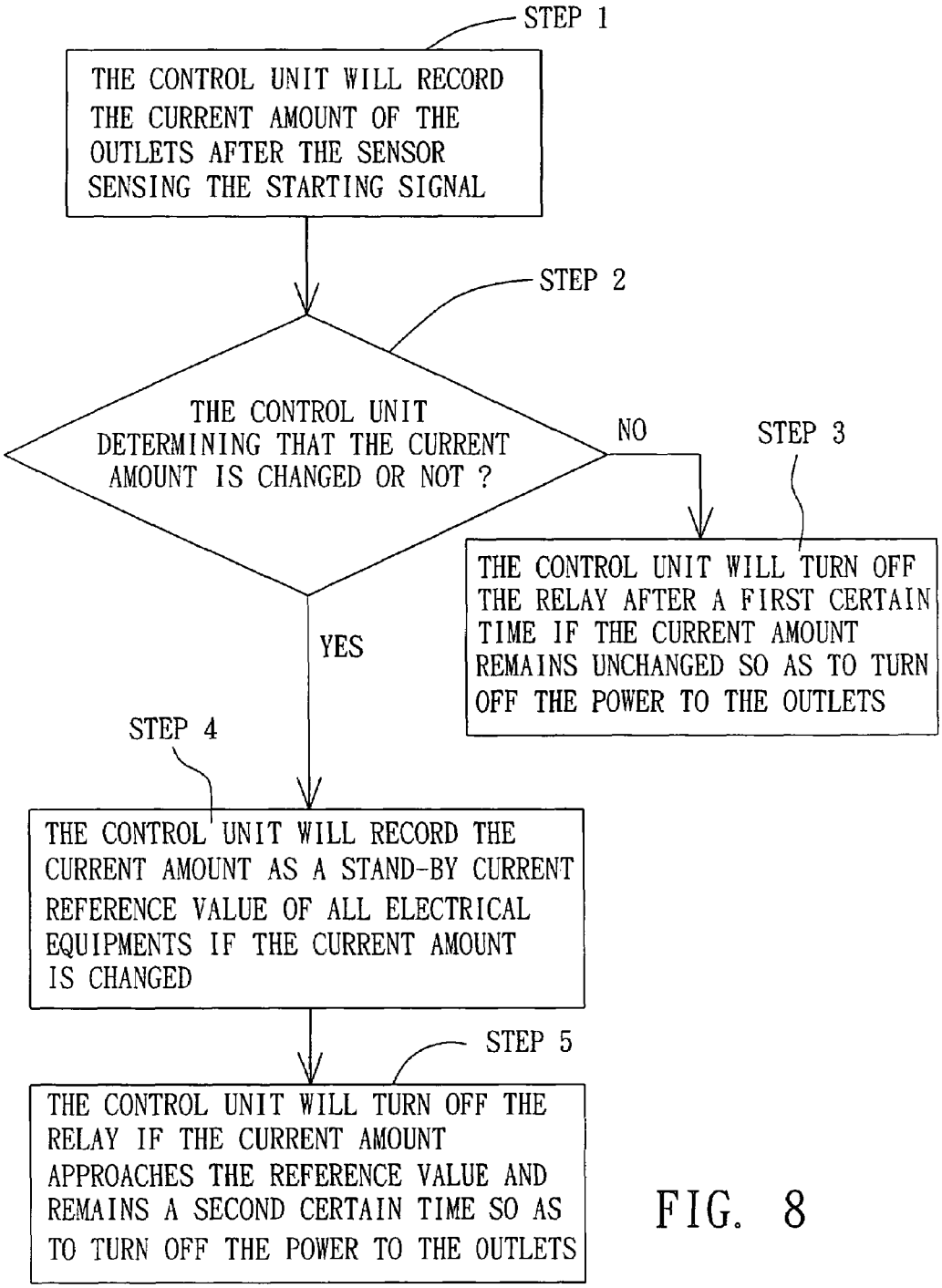
FIG. 8 shows a flowchart of the determining program in the memory according to one embodiment of the present invention.

Furthermore, the energy saving outlet of the present invention further comprises a determining program stored in the memory, which can determine the electrical equipment whether operates or not according to the current amount fed back to the current sensor 60, wherein, the determining theorem and steps of the determining program please refer to FIG. 8.

Furthermore, the energy saving outlet of the present invention further comprises a protecting circuit 65, which is disposed in the housing 10 and coupled between the current sensor 30 and the outlet 20 for executing by-pass function when the current amount is overloaded so as to protect the outlet from being destroyed. Wherein, the protecting circuit 65 is a surge protecting circuit or an EMI filter.

Furthermore, the energy saving outlet of the present invention further comprises a switch 66 and a third opening 13 is disposed on the housing 10, wherein, the switch 66 is disposed in the housing 10 and exposed the third opening 13, and the switch 66 is coupled between the power input terminal 55 and the relay 50 for turning ON or turning OFF the power.

Figure 3:
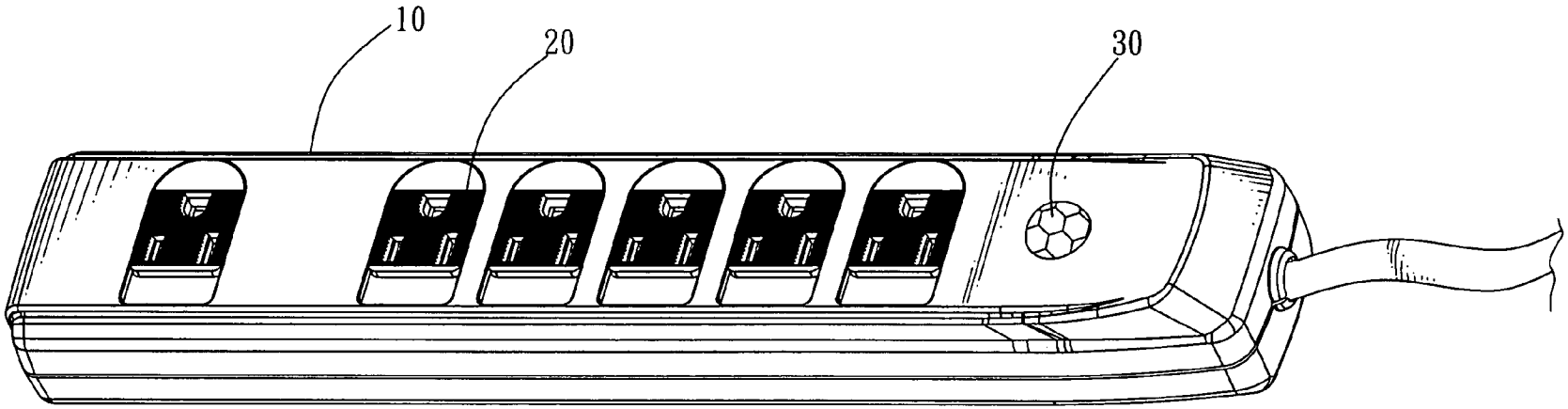
FIG. 3 shows an assembly view of an energy saving outlet according to still another embodiment of the present invention.

Referring to FIG. 3, it shows an assembly view of an energy saving outlet according to still another embodiment of the present invention. As shown in the FIG., the difference between FIG. 1 and FIG. 3 is that the sensor 30 is a pyroelectric passive infrared (PIR) sensor which can sense any movement of a human being, for example in a case of operating a television, when a user presses a start key of a remote controller (not shown) for emitting a starting signal, the pyroelectric passive infrared sensor 30 will receive the starting signal emitted from the remote controller, immediately, meanwhile, the control unit 40 will transmit a control signal to the relay 50 and change it to the ON state, therefore, power will supply to the outlets 20, such that the television can normally operate; but if the pyroelectric passive infrared sensor 30 senses a movement IR signal of a human being in a certain time (such as 5-10 minutes), that means the user does not sit on (or stand at) a certain place (such as sit on a sofa) and watches the television but walks at one's pleasure, therefore, the control unit 40 will determine that the starting signal is an error signal and turn OFF the power to the outlets 20, so as to avoid the error operating of the sensor 30.

Figure 4:
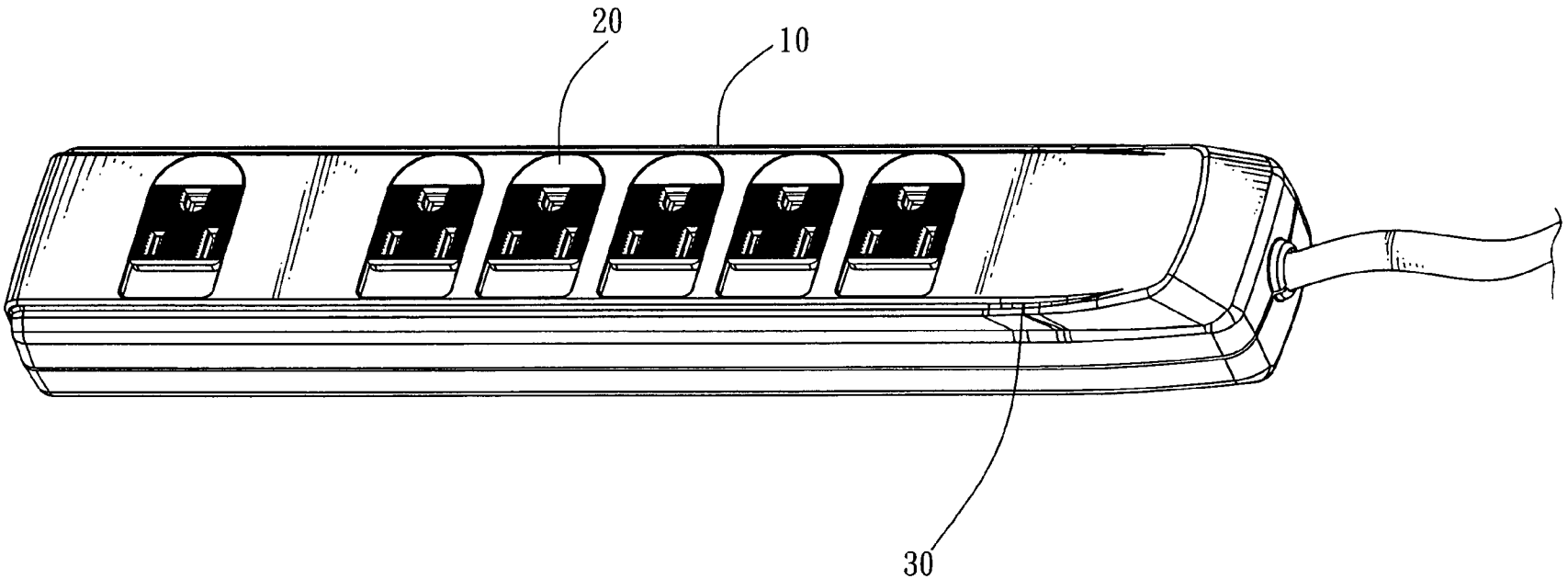
FIG. 4 shows an assembly view of an energy saving outlet according to another embodiment of the present invention.

Referring to FIG. 4, it shows an assembly view of an energy saving outlet according to still another embodiment of the present invention. As shown in the FIG., the difference between FIG. 1 and FIG. 4 is that the sensor 30 is a radio frequency sensor which can sense any specific radio frequency signals emitted by the remote controller of the electrical equipment, for example in a case of operating a television, when a user presses a start key of a remote controller (not shown) for emitting a starting signal, the radio frequency sensor 30 will receive the starting signal emitted from the remote controller, immediately, meanwhile, the control unit 40 will transmit a control signal to the relay 50 and change it to the ON state, therefore, power will supply to the outlets 20, such that the television can operate normally; therefore, the energy saving outlet of the present invention will not generate the stand-by current and consume power, so as to achieve the goal of energy saving and overcome the aforesaid drawbacks of the prior art outlet.

Figure 5:
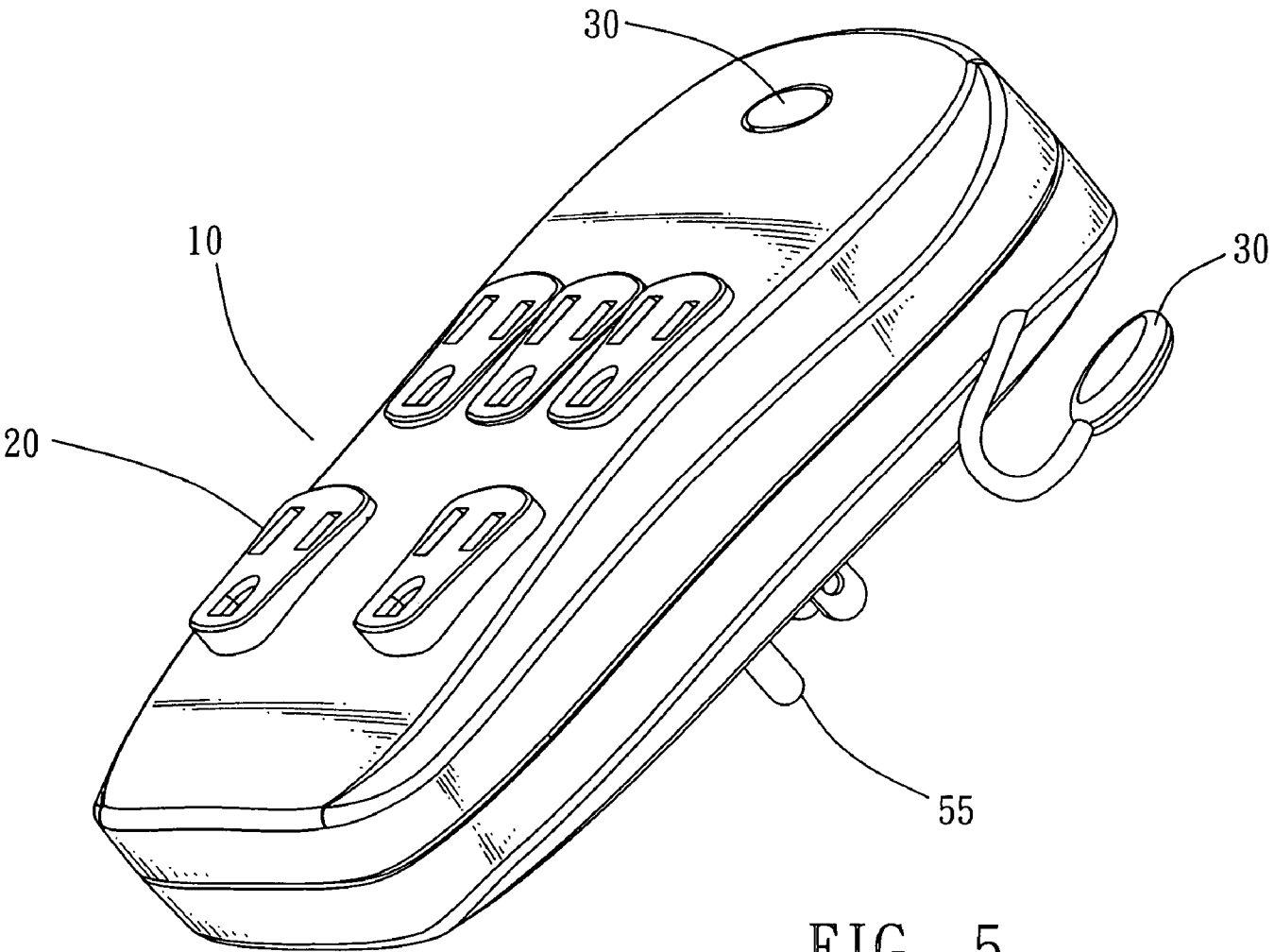
FIG. 5 shows an assembly view of an energy saving outlet according to still another embodiment of the present invention.

Referring to FIG. 5, it shows an assembly view of an energy saving outlet according to still another embodiment of the present invention. As shown in the FIG., the power input terminal 55 of the energy saving outlet can be disposed beneath the housing 10 so as to save the volume of the energy saving outlet. Furthermore, the sensor 30 of the energy saving outlet can either be disposed exposed the first opening 11 or extended a certain length by a wire 66 to increase its sensitivity, furthermore, the energy saving outlet of the present invention also can comprise more than one Infrared sensors 30.

Figure 6:
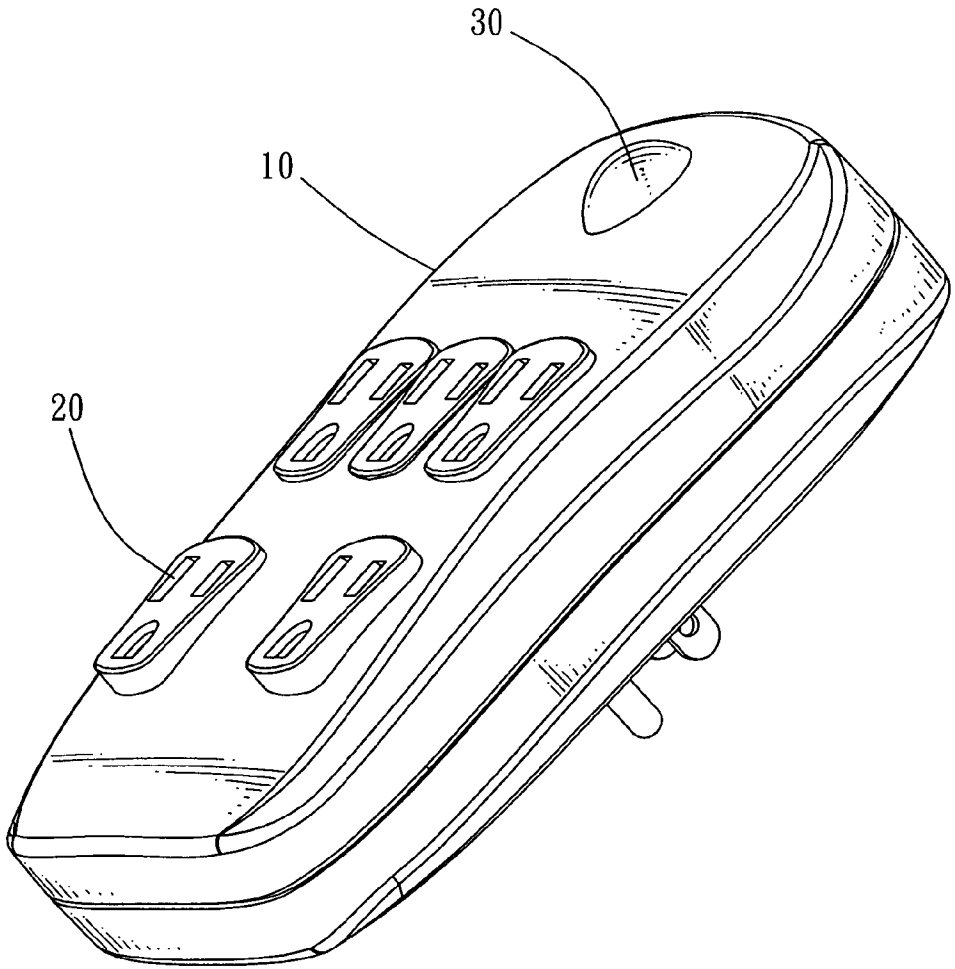
FIG. 6 shows an assembly view of an energy saving outlet according to still another embodiment of the present invention.

Referring to FIG. 6, it shows an assembly view of an energy saving outlet according to still another embodiment of the present invention. As shown in the FIG., the power input terminal 55 of the energy saving outlet can be disposed beneath the housing 10 so as to save the volume of the energy saving outlet. Furthermore, the pyroelectric passive infrared sensor 30 is disposed exposed the first opening 11 to increase its sensitivity.

Figure 7:
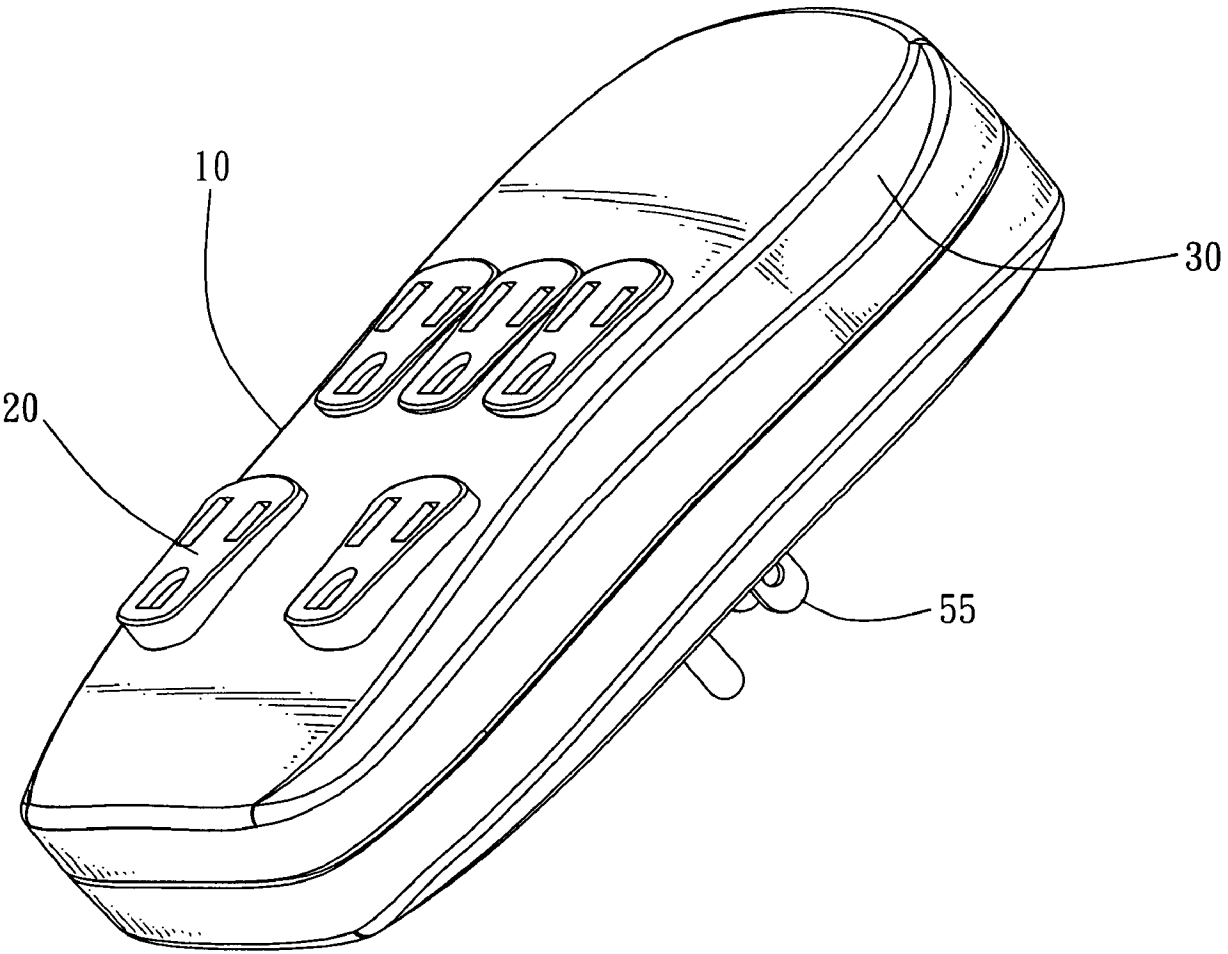
FIG. 7 shows an assembly view of an energy saving outlet according to still another embodiment of the present invention.

Referring to FIG. 7, it shows an assembly view of an energy saving outlet according to still another embodiment of the present invention. As shown in the FIG., the power input terminal 55 of the energy saving outlet can be disposed beneath the housing 10 so as to save the volume of the energy saving outlet. Furthermore, the radio frequency sensor 30 is also disposed beneath the housing 10.

Referring to FIG. 8, it shows a flowchart of the determining program in the memory according to one embodiment of the present invention. As shown in the FIG., the control unit 40 further comprises a determining program which comprises following steps: the control unit 40 will record the current amount of the outlet(s) 20 after the sensor 30 sensing the starting signal (step 1); the control unit 40 determining that the current amount is changed or not (step 2); the control unit 40 will turn OFF the relay 50 after a first certain time if the current amount remains unchanged so as to turn OFF the power to the outlet(s) 20 (step 3); the control unit 40 will record the current amount as a stand-by current reference value of all electrical equipments if the current amount is changed (step 4); and the control unit 40 will turn OFF the relay 50 if the current amount approaches the reference value and remains a second certain time so as to turn OFF the power to the outlet(s) 20 (step 5).

Wherein step 1, the current amount is fed back to the analog to digital conversion port of the control unit 40 and converted into a digital value then stored in the memory (not shown).

Wherein step 3, if the control unit 40 determines that the current amount remains unchanged, it means that the electrical equipment is not actuated, then the control unit 40 will turn OFF the relay 50 after a first certain time, so as to turn OFF the power to the outlet(s) 20; wherein, the first certain time is for example but not limited to 5~10 minutes.

Wherein step 4, if the control unit 40 determines that the current amount is changed, it means the electrical equipment is actuated, then the control unit 40 will record the current amount as a stand-by current reference value of all electrical equipments.

Wherein step 5, if the control unit 40 determines that the current amount approaches the reference value and remains a second certain time, then the control unit 40 will turn OFF the relay 50, so as to turn OFF the power to the outlet(s) 20; wherein, the second certain time is for example but not limited to 5~10 minutes.

Figure 9:
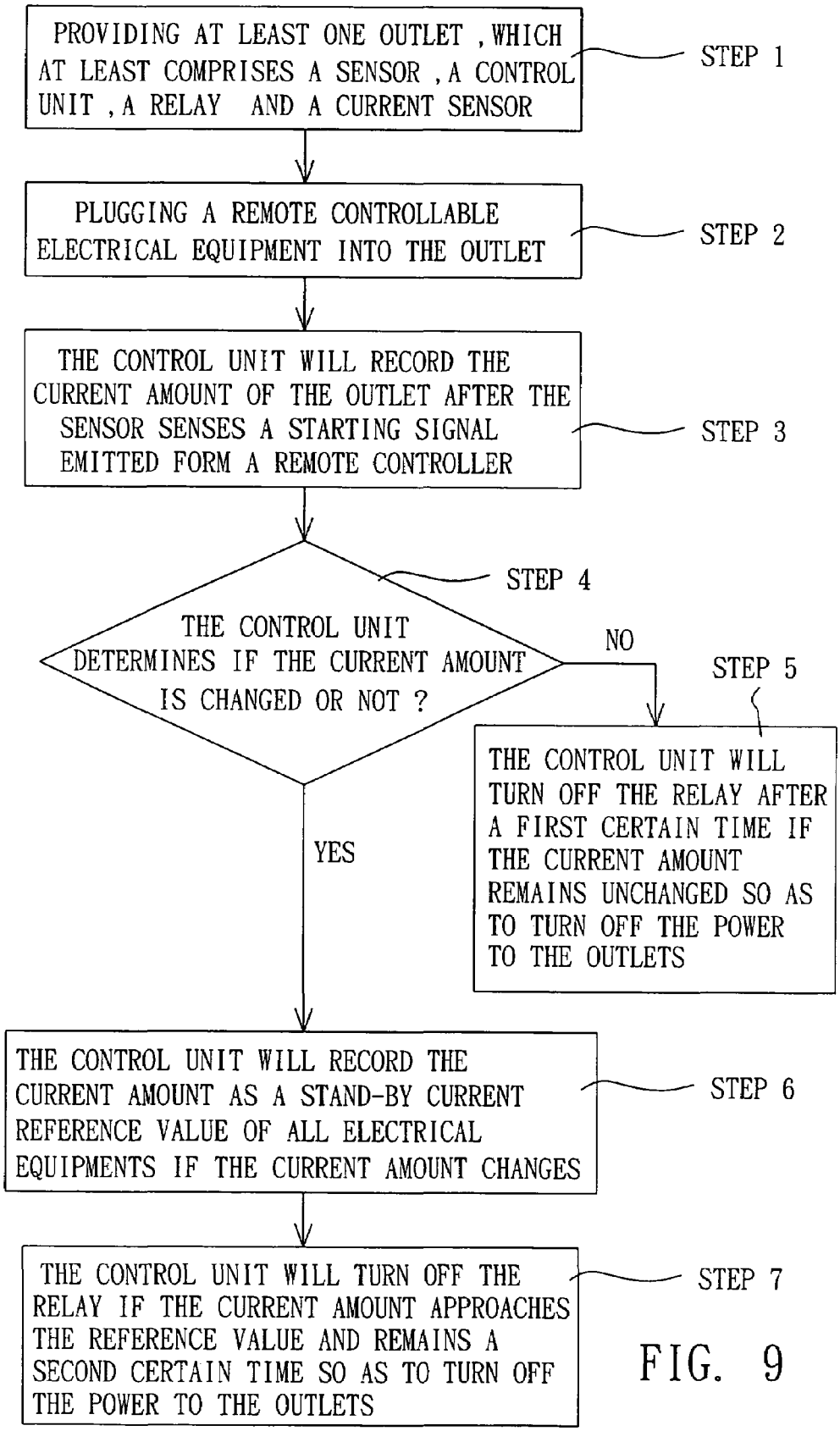
FIG. 9 shows a flowchart of the energy saving method by using an outlet according to one embodiment of the present invention.

Furthermore, the present invention also provides an energy saving method by using an outlet. Please refer to FIG. 9, it shows a flowchart of the energy saving method by using an outlet according to one embodiment of the present invention. As shown in the FIG., the energy saving method by using an outlet further comprises following steps: providing at least one outlet 20, which at least comprises a sensor 30, a control unit 40, a relay 50 and a current sensor 60 (step 1); plugging a remote controllable electrical equipment into the outlet 20 (step 2); the control unit 40 will record the current amount of the outlet 20 after the sensor 30 senses a starting signal emitted form a remote controller (step 3); the control unit 40 determines if the current amount is changed or not (step 4); the control unit 40 will turn OFF the relay 50 after a first certain time if the current amount remains unchanged so as to turn OFF the power to the outlet(s) 20 (step 5); the control unit 40 will record the current amount as a stand-by current reference value of all electrical equipments if the current amount changes (step 6); and the control unit 40 will turn OFF the relay 50 if the current amount approaches the reference value and remains a second certain time so as to turn OFF the power to the outlet(s) 20 (step 7).

Wherein step 1, the sensor 30 is an Infrared sensor, a pyroelectric passive infrared, a radio frequency sensor or their combination; wherein, the Infrared sensor 30 can sense any Infrared signals emitted by a remote controller of the electrical equipment; the pyroelectric passive infrared sensor 30 can sense any movement of a human being; and the radio frequency sensor 30 can sense any specific radio frequency signals emitted by the remote controller of the electrical equipment. Furthermore, the control unit 40 further comprises a memory and an analog to digital conversion port (not shown).

Wherein step 5, the first certain time is for example but not limited to 5~10 minutes.

Wherein step 7, the second certain time is for example but not limited to 5~10 minutes.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An energy saving outlet, which comprises:

a housing, having at least one first opening and a second opening thereon, for disposing the following elements;

at least one outlet, disposed in said housing and exposed through said first opening, for providing an electrical equipment being plugged into;

a sensor, disposed in said housing and exposed through said second opening, configured to sense a starting signal of said electrical equipment;

a control unit, disposed in said housing and coupled to said sensor, for outputting a control signal when receives said starting signal;

a relay, one end being coupled to a power input terminal, and another end being coupled to said control unit, for being changed to an on or off state through said control signal;

thereby said energy saving outlet can turn OFF its power when said electrical equipment enters the stand-by state, so as to achieve the goal of energy saving.

2. The energy saving outlet as claimed in claim 1, wherein said housing is made of insulating material.

3. The energy saving outlet as claimed in claim 1, wherein quantity of said outlets is the same as a quantity of said first openings.

4. The energy saving outlet as claimed in claim 1, wherein said sensor is an Infrared sensor, a pyroelectric passive infrared sensor, a radio frequency sensor or their combination; wherein, said Infrared sensor can sense any infrared signals emitted by a remote controller of said electrical equipment; said pyroelectric passive infrared sensor can sense any movement of a human being; and said radio frequency sensor can sense any specific radio frequency signals emitted by said remote controller of said electrical equipment.

5. The energy saving outlet as claimed in claim 1, wherein said control unit is a microcontroller, and it further comprises a memory and an analog to digital conversion port.

6. The energy saving outlet as claimed in claim 5, wherein it further comprises a current sensor coupled between said relay and said controller unit, which is configured to measure a current of said outlet and feed it back to said analog to digital conversion port and transmit it to said control unit after being converted into a digital signal.

7. The energy saving outlet as claimed in claim 5, wherein it further comprises a determining program stored in said memory, which can determine said electrical equipment whether operates or not according to said feedback current sensed by said current sensor.

8. The energy saving outlet as claimed in claim 7, wherein said determining program further comprises following steps:

said control unit will record said current of said outlet after said sensor sensing said starting signal;

said control unit determining that said current is changed or not; said control unit will turn OFF said relay after a first certain time if said current remains unchanged so as to turn OFF said power to said outlet;

said control unit will record said current as a stand-by current reference value of all electrical equipments if said current changes; and said control unit will turn OFF said relay if said current approaches said reference value and remains a second certain time so as to turn OFF said power to said outlet.

9. The energy saving outlet as claimed in claim 8, wherein said first certain time and said second certain time is 5~10 minutes, respectively.

10. The energy saving outlet as claimed in claim 1, wherein it further comprises a protecting circuit disposed in said housing and coupled between said current sensor and said outlet for executing by-pass function when said current is overloading so as to protect said outlet.

11. The energy saving outlet as claimed in claim 10, wherein said protecting circuit is a surge protecting circuit or an EMI filter.

12. The energy saving outlet as claimed in claim 1, wherein it further comprises a switch and a third opening disposed on said housing, wherein, said switch is disposed in said housing and exposed said third opening, and said switch is coupled between said power input terminal and said relay for turning ON or turning OFF said power.

13. An energy saving method by using an outlet, which comprises the steps of:

providing at least one outlet, which at least comprises a sensor, a control unit, a relay and a current sensor;

plugging a plug of a remote controllable electrical equipment into said outlet;

said control unit will record said current of said outlet after said sensor sensing a starting signal emitted from a remote controller of said electrical equipment;

said control unit determining that said current is changed or not; said control unit will turn OFF said relay after a first certain time if said current remains unchanged, so as to turn OFF said power to said outlet;

said control unit will record said current a stand-by current reference value of all electrical equipments if said current is changed; and said control unit will turn OFF said relay if said current approaches said reference value and remains a second certain time so as to turn OFF said power to said outlet and save power during said stand-by state.

14. The energy saving method by using an outlet as claimed in claim 13, wherein said sensor is an Infrared sensor, a pyroelectric passive infrared sensor, a radio frequency sensor or their combination;

wherein, said Infrared sensor can sense any Infrared signals emitted by a remote controller of said electrical equipment;

said pyroelectric passive infrared sensor can sense any movement of a human being; and said radio frequency sensor can sense any specific radio frequency signals emitted by said remote controller of said electrical equipment.

15. The energy saving method by using an outlet as claimed in claim 13, wherein said control unit is a microcontroller, and it further comprises a memory and an analog to digital conversion port.

16. The energy saving method by using an outlet as claimed in claim 13, wherein said first certain time and said second certain time is 5~10 minutes, respectively.

* * * * *